United States Patent [19]

Seeger, Jr. et al.

[11] Patent Number: 4,637,551

[45] Date of Patent: Jan. 20, 1987

[54] SAFETY GUARD FOR AIRLESS SPRAY APPARATUS

[75] Inventors: John W. Seeger, Jr., St. Paul; John W. Kubiak, Minnetonka, both of Minn.

[73] Assignee: Seeger Corporation, St. Paul, Minn.

[21] Appl. No.: 720,087

[22] Filed: Apr. 5, 1985

[51] Int. Cl.[4] ..... B05B 1/28; B05B 9/01

[52] U.S. Cl. ..... 239/288.5; 239/DIG. 22

[58] Field of Search ..... 239/DIG. 22, 288–288.5, 239/600, 525–527, 505, 522

[56] References Cited

U.S. PATENT DOCUMENTS

| | | | |
|---|---|---|---|
| 3,913,844 | 10/1975 | Petrovic | 239/600 X |
| 3,944,141 | 3/1976 | Siczek | 239/288.5 |
| 3,963,180 | 6/1976 | Wagner | 239/288.5 |
| 4,025,045 | 5/1977 | Kubiak | 239/600 X |
| 4,095,747 | 6/1978 | Anderson | 239/288.5 |
| 4,162,042 | 7/1979 | Mommsen et al. | 239/526 |
| 4,181,261 | 1/1980 | Crum | 239/600 X |
| 4,239,157 | 12/1980 | Fasth | 239/288.5 |
| 4,360,132 | 11/1982 | Vilagi et al. | 239/DIG. 22 X |
| 4,541,568 | 9/1985 | Lichfield | 239/526 X |

FOREIGN PATENT DOCUMENTS

| | | | |
|---|---|---|---|
| 1114598 | 12/1981 | Canada | 239/288 |

*Primary Examiner*—Andres Kashnikow
*Assistant Examiner*—Kevin Patrick Weldon
*Attorney, Agent, or Firm*—Merchant, Gould, Smith, Edell, Welter & Schmidt

[57] ABSTRACT

Method and apparatus for guarding a spray tip (36) of a spray gun (10). A tip guard (20) is suitable for being connected to the gun (10) and the tip guard (20) includes an axially extending portion (34) which defines a tip guard cavity (32). The tip guard cavity (32) is in fluid communication with the liquid carrying passageways within the gun (10). Tip guard cavity (32) also extends axially downstream of the orifice (38) of the spray tip (36) whereby if the axially extending portion (34) is dangerously shortened, the tip guard cavity (32) will be exposed to the atmosphere to relieve the pressure within the spray tip cavity (46) immediately adjacent to the upstream end of the spray tip orifice (38). The velocity pressure generated by the gun (10) is thereby reduced to a level which is substantially safe.

27 Claims, 2 Drawing Figures

SAFETY GUARD FOR AIRLESS SPRAY APPARATUS

FIELD OF THE INVENTION

The present invention relates generally to methods and apparatus for airless spraying, and more particularly to an improved safety tip guard for airless spray tips.

BACKGROUND OF THE INVENTION

Liquid spraying has been used to great advantage for many years in many applications. One of the most common uses for liquid spraying is for surface coating of substrates with thin layers of paint or varnish, for example. The present invention is directed to liquid spraying techniques and apparatus, but is not limited to any particular liquid.

Although there are many known techniques for spraying a liquid, each of these techniques can generally be characterized as an air spraying technique or an airless spraying technique. The present invention is directed to the latter techniques.

Both airless and air spray techniques are accomplished by forcing a liquid through a small orifice. According to the air spray technique, the liquid is intermixed with pressurized air and the mixture is sprayed through an orifice under pressure. Typically, the air pressure is on the order of approximately 10–50 pounds per square inch gauge (psi). In view of this, it is generally perceived that air spraying is reasonably safe because the driving air pressure is relatively low and therefore the velocity of the liquid droplets near the orifice is correspondingly low. However, air spraying requires not only a source of liquid (e.g., paint) but also requires access to a supply of pressurized air.

In airless spraying, the liquid itself it maintained under high hydraulic pressure, typically on the order of approximately 500–3,000 psi and this highly pressurized liquid is forced through a spray tip orifice to create the necessary atomization. Since an auxiliary air supply is unnecessary, and in view of superior functional characteristics and economies, airless spraying is perceived to possess several advantages over air spraying for some applications. However, the large hydraulic pressures contribute to a very high exit velocity near the downstream end of the spray tip orifice. In fact, the velocity near the spray tip can be so high that the exiting stream can, in some instances, penetrate human flesh when the flesh is positioned closely adjacent the spray tip orifice. When such penetration occurs, the fluid injected through the flesh may spread out along the underlying muscle layer, and, especially when the fluid is toxic as in the case of some paint ingredients, cause serious injury.

In general, there is a potential for injection of liquid dispensed from an airless spraying apparatus only if the flesh is very close to the orifice. In view of this, recently there has been a trend toward providing airless spraying apparatus with tip guards or nozzle guards which fit over the spray tip so as to prevent the human operator from placing his hand or any part of his body in sufficiently close proximity to the spray tip orifice as to create a potential for liquid injection of material emanating from the spray tip orifice.

Airless spray tip guards are typically suitable for mounting to the nozzle end of the barrel or body of an airless spray gun, and are typically axially aligned and outwardly concentric with respect to the axis of the spray tip orifice and the axis of the spray which emanates therefrom.

Such tip guards are typically tube-like and flared or notched to accommodate the fan-shaped spray emanating from the typical spray tip orifice. U.S. Pat. No. 3,963,180 discloses a flared nozzle guard whereas U.S. Pat. No. 4,025,045 discloses a substantially cylindrical guard having axial diametrally opposed notches.

In addition, such tip guards typically include axially extending portions which are approximately ¾ to 1 inch long. The axially extending portions are intended to prevent fingers, hands, etc., from getting dangerously close to the spray tip orifice.

Unfortunately, in spite of the fact that most if not all manufacturers of airless spraying equipment provide such guards, injection accidents continue to occur. An accident can occur when a spray gun is inadvertently activated absent its tip guard. A tip guard might be removed to provide access to the inner portions of the gun so that they can be cleaned or repaired.

Several prior art nozzle guard systems have been developed to eliminate accidents in cases of loosened or removed nozzle guards. For example, U.S. Pat. No. 4,360,132 discloses a safety control apparatus for an automatic airless spray gun. If the safety guard is removed or loosened the air pressure which operates the hydraulic valve within the spray gun is relieved and insufficient air pressure is available to overcome the return spring of the hydraulic valve. U.S. Pat. Nos. 3,944,141 and 3,913,844 each disclose a tip guard which, if removed, prevents the spray gun from being activated. Thus, these tip guards are only directed to accidents which occur due to the loosening or removal of a tip guard.

Sometimes, however, injection accidents are as a result of the axially extending portion(s) of a guard having been sawn or broken off. The techniques disclosed in U.S. Pat. Nos. 4,360,132, 3,944,141 and 3,913,844 cannot prevent injection accidents when a guard is in place but has been dangerously shortened. The axially extending portion(s) of a tip guard might inadvertantly break off. Alternatively, an operator might intentionally remove the axially extending portion(s) if he thinks that the guard is interfering with the spray or if he wants to have immediate access to the spray tip to clean it.

U.S. Pat. No. 4,181,261, issued to G. Crum, discloses a safety system for an airless spray nozzle which is directed to the problem of a tip guard which has been dangerously shortened, whether accidentally or intentionally. As disclosed in Crum, the system preferably includes a compressed air supply; a tip guard having axially extending portions which form a tip guard cavity; a normally closed pneumatically actuated hydraulic valve; and conduits interconnecting the air supply to the cavity within the tip guard and connecting the tip guard cavity to the pneumatically controlled hydraulic valve. If the air pressure supplied to the normally closed valve is relieved for any reason the valve will close to prevent liquid from flowing to the nozzle portion of the "airless" spray gun. The air pressure would be relieved if the tip guard were removed or if one or both of the axially extending portion(s) were broken or sawn off. If the tip guard cavity is exposed, the air bleeds through the cavity and into the atmosphere and the normally closed hydraulic valve closes to prevent the flow of liquid, e.g., paint.

The Crum technique discussed above is indeed directed to the problem of a broken or truncated tip guard. However, the Crum apparatus requires the use of an auxiliary power supply such as an air supply, and also requires the use of an additional hydraulic valve in the liquid handling system. Thus, the Crum system is not usable if an auxilliary power supply, such as a compressed air supply, is unavailable. Further, the Crum technique is expensive since it requires the additional valve and the conduits which serve to interconnect the pneumatic components. In addition, the air conduits only serve to make the spray gun heavier and less maneuverable.

Importantly, the preferred embodiment of the Crum system shown in the figures can easily be defeated by connecting the air supply directly to the normally closed pneumatically actuated hydraulic valve. If this direct connection is made, the tip guard can be shortened without interfering with the flow of liquid through the spray tip orifice.

The present invention includes a method and apparatus for guarding the spray tip orifice of an airless spraying apparatus. The invention provides a safety technique for discouraging the shortening of a spray tip guard. The technique is very cost effective and does not require additional components such as valves or auxiliary power supplies. Further, the method and apparatus of the present invention are very difficult to override and should effectively prevent the intentional or unintentional shortening of the tip guard.

SUMMARY OF THE INVENTION

The present invention includes a method and apparatus for airlessly spraying a liquid. Broadly, the apparatus of the present invention includes a spray tip forming a spray tip orifice having an axis, an upstream end and a downstream end; means for carrying the liquid from a pressurized source of the liquid to the upstream end of the spray tip orifice; a supply cavity in fluid communication with the liquid carrying means; and a safety tip guard operatively disposed relative to the liquid carrying means and the spray tip, the safety tip guard including an axially extending portion proximate the downstream end of the spray tip orifice, the axially extending portion comprising a tip guard wall forming a tip guard cavity in fluid communication with the supply cavity, whereby when the supply cavity contains the pressurized liquid a breach in the tip guard wall will allow a portion of the liquid to escape through the breach.

Preferably, the supply cavity which is in fluid communication with the tip guard cavity includes a spray tip cavity which is adjacent to the upstream end of the spray tip orifice. In the event of a breach in the axially extended portion of the tip guard, the liquid will escape through the breach thereby decreasing the pressure in the spray tip cavity and also of the spray ejected through the spray tip orifice to a safe level. Thus, flesh injection should be avoided.

In preferred embodiments, the tip guard cavity extends axially within the axially extending portion of the safety tip guard to a safe distance from the spray tip orifice. Thus, if an attempt is made to shorten the axially extending portion to make it dangerously short, the tip guard cavity will be exposed to the atmosphere and liquid will pour through the breach in the wall of the axially extended portion.

Also, preferably, the safety tip guard is configured as a "duck bill" tip guard. Such tip guards are fairly common and they include a pair of axially extending tines. With the duck bill tip guard, the tip guard cavity preferably includes a pair of axially extending cavities which are formed by the inner and outer walls of the duck bill tines. Also, preferably, the tip guard cavities within the tines extend axially within the tines at least to a safe distance from the spray tip orifice.

And, preferably, the airless spraying apparatus is a spray gun.

The invention also includes a safety tip guard which is suitable for use with a spray tip of an airless spraying apparatus, wherein the spray tip forms a spray tip orifice; the apparatus includes liquid carrying means for carrying the liquid from a pressurized source to the upstream end of the spray tip orifice; the apparatus includes a supply cavity in fluid communication with the liquid carrying means; and wherein the tip guard includes an axially extending portion which comprises a tip guard wall forming a tip guard cavity. The tip guard cavity is suitable for being in fluid communication with the supply cavity, whereby when the safety tip guard is properly positioned with respect to the liquid carrying means and the spray tip and when the supply cavity contains the pressurized liquid a breach in the tip guard wall will allow a portion of the liquid to escape through the breach.

In preferred embodiments, the safety tip guard of the invention which is suitable for use with an airless spraying apparatus includes the limitations set forth above with respect to the airless spraying apparatus. Thus, for example, the safety tip guard which is suitable for use with an airless spraying apparatus preferably includes a tip guard cavity which extends axially within the axially extending portion of the tip guard to a safe distance from the spray tip orifice.

A method for guarding a spray tip orifice of a spray tip of an airless spraying apparatus suitable for spraying a liquid, wherein the spray tip orifice has an axis, an upstream end and a downstream end; the apparatus comprises means for carrying the liquid from a pressurized source of the liquid to the upstream end of the spray tip orifice; and the apparatus comprises a supply cavity in fluid communication with the liquid carrying means, said method comprising: selecting a safety tip guard comprising an axially extending portion comprising a tip guard wall forming a tip guard cavity; operatively disposing the tip guard relative to the liquid carrying means; operatively disposing the tip guard relative to the spray tip; and placing the tip guard cavity in fluid communication with the supply cavity whereby when the supply cavity contains the liquid a breach in the tip guard wall will allow a portion of the liquid to escape through the breach.

A preferred method includes guarding a spray tip orifice of an apparatus which includes a spray tip cavity adjacent the upstream end of the spray tip orifice. The other limitations referred to above with respect to the spraying apparatus and with respect to the safety tip guard apply to preferred methods.

DESCRIPTION OF A PREFERRED EMBODIMENT

Figure 1:
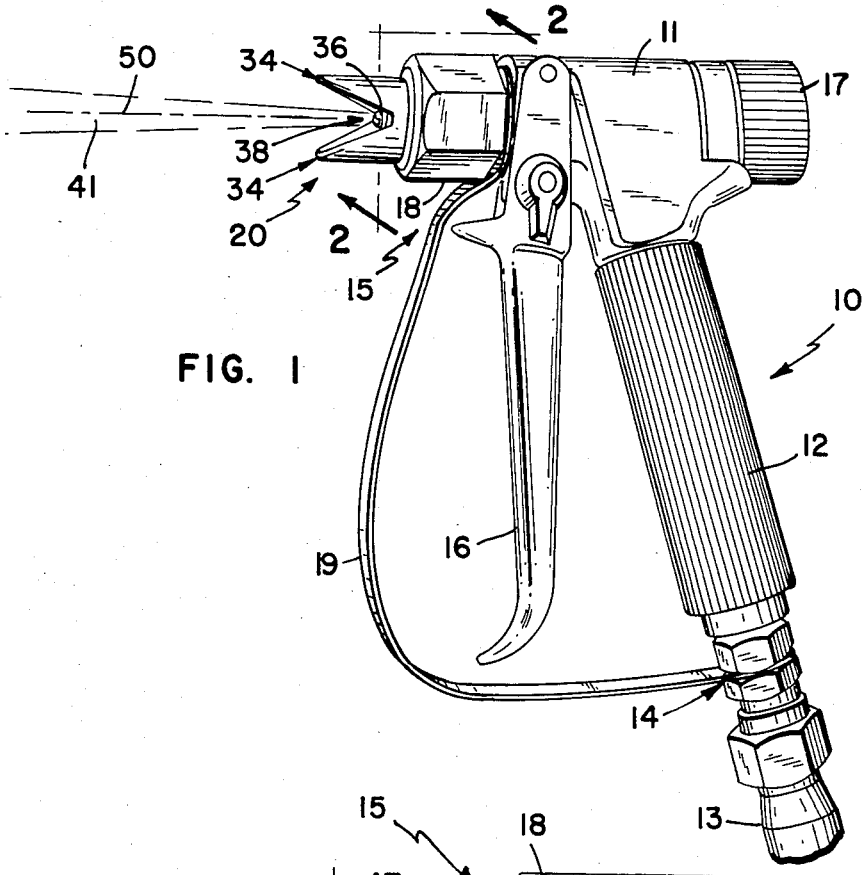
FIG. 1 is a perspective view of an airless spray gun equipped with a preferred embodiment of the spray tip guard of the present invention.

With reference to the drawing attached hereto, wherein like reference numerals represent like parts throughout the several views, FIG. 1 illustrates an airless spray gun 10. Although the spray tip guard of the present invention is not limited to any particular type of airless spraying device, a typical spray gun 10 will be described.

The gun 10 includes a body portion 11, a depending grip 12, and a nozzle discharge end 15. The grip 12 is attached to a pumped fluid conduit 13 through a standard swivel connection 14. The grip 12 and body portion 11 have internal fluid passageways communicating fluid from the conduit 13 to the nozzle discharge end 15. The gun 10 also includes a trigger 16 which is pivotably connected to the body portion 11 and which operates a hydraulic normally closed valve to selectively permit the flow of liquid through the grip 12, body portion 11, and nozzle section 15. In the preferred embodiment, the gun 10 also includes a trigger guard 19 for protecting the trigger 16 against inadvertent operation, for example, if the gun is dropped or bumped in handling.

Preferably, the conduit 13 is a flexible hydraulic hose which is capable of withstanding hydraulic pressures in excess of 3,000 psi, depending on the application. The conduit 13 is typically in fluid communication with a compressor or pump (not shown) which is suitable for providing adequate flow and pressure to atomize the liquid as it passes through the spray tip orifice (described below) of the airless spray gun 10.

Figure 2:
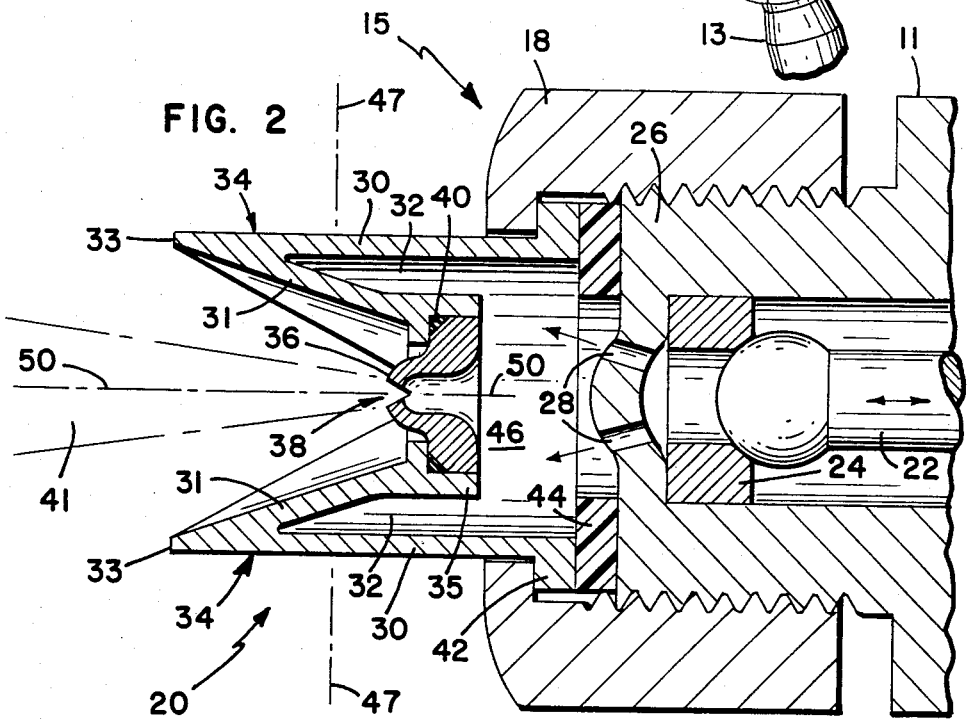
FIG. 2 is an enlarged fragmentary cross-sectional view of the spray tip guard and nozzle assembly of the airless spray gun of FIG. 1 taken along line 2—2.

Referring to FIG. 2, the nozzle discharge end 15 of the gun 10 includes a diffuser 26 which is mechanically connected and in fluid communication with the body portion 11. The diffuser 26 houses an internally disposed hydraulic valve (not shown in its entirety) which includes a needle 22 controlled by the trigger 16 to selectively allow flow of liquid through the passageways within the grip 12, body 11 and nozzle section 15 of the airless spray gun 10. The needle 22 seals against a washer-like valve seat 24 which is preferably made of tungsten carbide or the like. The valve seat 24 resides within the diffuser 26 at its discharge end.

An adjusting member 17 is threadedly connected to the body portion 11 at the opposite end of the body 11 from the nozzle section 15 and allows adjustment of the degree of valve opening and provides for control of the spray according to known principles. The nozzle discharge end 15 typically includes a tip nut 18, spray tip 36 (shown in FIG. 2) and spray tip guard member 20. The nut 18 forms internal threads which mate with the external threads of diffuser 26, and nut 18 serves to create a seal between the guard 20 and diffuser 26.

The internal bore of diffuser 26 terminates with a pair of diffuser ports 28 which preferably angle away from the axes of the needle member 22 and the inner bore of the diffuser 26.

As noted above, needle 22 is operatively connected to trigger 16 according to well known techniques. Referring to FIG. 2, when the trigger 16 is drawn toward grip 12, needle 22 moves to the right away from valve seat 24. Liquid is thereby allowed to flow through the diffuser ports 28.

As noted above, the nozzle discharge end 15 of airless spray gun 10 also preferably includes a tip guard 20. The tip guard 20 preferably includes an axially extending portion 34 which extends away from body 11. "Axially extending" refers to something which extends downstream of the spray tip 36 and which prevents someone from getting their hand, etc., dangerously close to the spray orifice 18 in the tip 36. Preferably, portions 34 axially extend at least approximately ½ inch to 1¼ inch downstream of the spray tip 36.

The tip guard 20 also preferably includes a radially outwardly extending lip 42 at the end of the tip guard 20 which is suitable for connecting to the body 11 of the gun 10. The lip 42 is engaged by tip nut 18 so as to be pressed into sealing engagement with a sealing washer 44 which is positioned between the lip 42 and the diffuser 26. Preferably, washer 44 is made of nylon to provide a good seal when faced with high liquid pressures. The tip guard 20 is preferably of die cast steel but could alternatively be made by other manufacturing methods such as cold heading, hot forging, sintering, or the like, and could also be made of stainless steel or other materials suitable for withstanding the hydraulic pressure and day-to-day punishment.

The axially extending portion 34 of tip guard 20 preferably includes an outer wall 30 and an inner wall 31. As shown in FIGS. 1 and 2, outer wall 30 is substantially in the nature of a tube which has been relieved by a pair of diametral crescent-shaped notches and which terminates at a point 33 at the opposite end of wall 30 from lip 42. Inner wall 31 is attached to wall 30 at point 33 and angles radially inward in the nature of a notched funnel. It can be seen that the walls 30 and 31 of the axially extending portion 34 form a tip guard cavity 32 which also extends axially from the body 11 of gun 10. Clearly, other tip guard cavity configurations are contemplated, as further discussed below. Also, preferably the tip guard cavities extend axially within the extended portions or tines 34 at least to a "safe distance" from spray tip 36. If this is so, any excessive axial shortening of the portions 34 will result in the tip guard cavities 32 being exposed to ambient conditions which will cause the pressure immediately upstream of the spray tip orifice (discussed below) to decrease, thereby decreasing the velocity pressure created by the spray to a safe level and effectively disabling the spray gun 10.

The proximal end 35 of inner wall 31, at the apex of the notched "funnel" formed by inner wall 31, is formed to receive the spray tip 36, preferably of tungsten carbide construction. The spray tip 36 forms a spray tip orifice 38 which is sufficiently small to generate the high velocities necessary to atomize the fluid as it is pumped therethrough. Typically, orifice sizes can range from approximately 0.010 to 0.050 inch in diameter. The orifice has an upstream end which receives the fluid and a downstream end which releases the fluid into the atmosphere. Further, the orifice has an axis 50 which is preferably substantially collinear with the longitudinal axes or center lines of needle 22 and tip guard 20. The spray tip 36 is preferably press fit into the region 35 of tip guard 20 with an O-ring 40 sealingly engaging the two elements.

Referring to FIG. 2, it can be seen that a spray tip cavity 46 is formed by the diffuser 26, tip guard outer wall 30 and spray tip 36. Such a cavity 46 exists in all airless spray devices. That is, all such devices include a cavity which is in fluid communication with the spray tip and on its upstream side. It can also be seen that the cavity 46 is in fluid communication with the tip guard cavity 32 extending into the axially extending portion 34 of the tip guard 20. And, it can be seen that the axially extending portion 34 is preferably adjacent to or proximate the downstream end of orifice 38. That is, since the axially extending portion 34 of guard 20 is designed to guard tip 36 and orifice 38, it is entirely reasonable that at least a protion of the extending portion 34 be proximate the downstream end of the orifice 38.

The operation of the airless spray apparatus 10 can be described. The conduit 13 is first connected to a source of pressurized liquid. Pressurized liquid is thereby provided to the internal passageways of conduit 13, grip 12 and body 11 and ultimately into the diffuser 26 in the nozzle and body portions 15 and 11, respectively, of the spray gun 10. As is well known, a spring (not shown) normally holds the needle 22 in sealing engagement with the valve seat 24. When elements 22 and 24 are in such engagement, the liquid cannot pass the needle 22 and cannot flow through the diffuser ports 28 into the cavity 46.

When it is desired to generate a spray, the trigger 16 is pulled toward the depending grip 12 of the gun 10. This causes the needle 22 to move to the right (as shown in FIG. 2) so as to pull it out of sealing engagement with sealing element 24. This allows the pressurized liquid to flow through the diffuser ports 28 and into the cavity 46 as shown in FIG. 2. Due to the relatively small diameter of the orifice 38, the liquid tends to fill the cavity 46 and the tip guard cavity 32. Finally, the liquid flows through the tip orifice 38 and issues as a spray 41, the center line of which is preferably substantially collinear with orifice center line 50.

If a breach occurs in the wall 30 or 31 of the axially extending portion 34 of the tip guard 20, a portion of the liquid which flows through the diffuser ports 28 will flow through the breach instead of flowing solely through the spray tip orifice 38. If the liquid happens to be paint, the flow of paint through the breach in the wall 30 will obviously create quite a mess. Clearly, this should discourage anyone from intentionally cutting into the cavity 32 of the tip guard 20. Also, the pressure in spray tip cavity 46 should drop to a safe level if liquid is pouring out of extended portions 34. For example, referring to FIG. 2, if the tip of guard 20 were sawn off at line 47, very little paint would continue to flow through the orifice 38, and most would flow through the comparatively large breach in walls 30 and 31. Also, since the spray tip 36 is preferably press fit into section 35 of the tip guard 20, if the guard 20 is altogether removed the spray 41 is not produced.

It should be noted that the tip guard 20 need not have the particular configuration shown in FIGS. 1 and 2. That is, the tip guard 20 need not be in the "duck bill" configuration and in fact the principles of the present invention are applicable to any type of tip guard.

It should also be noted that the tip guard cavity 32 need not have the particular configuration shown in FIG. 2. For example, the cavity 32 could be in the nature of a plurality of cylindrical holes which are substantially parallel to each other and to the center line of the spray 41. Such holes could be drilled out of the tip guard, or could be molded in during the tip guard's casting, for example. The tip guard cavity could, for example, also be in a honeycomb pattern, or could be configured from stainless steel tubing or the like. It is important that the tip guard cavity 32 in the axially extending portion 34 be in fluid communication with the source of fluid, but beyond that the particular shape and construction of the cavity 32 and the particular shape and construction of the tip guard 20 are not critical.

Similarly, the "spray tip cavity" 46 need not have the precise configuration shown in FIG. 2. In fact, while it is important that the tip guard cavity 32 ultimately be in fluid communication with the source of pressurized liquid, it is not necessary that the "spray tip cavity" be located immediately upstream of the upstream end of spray tip orifice 38. More generally, the "spray tip" cavity is a "supply" cavity in fluid communication with the pressurized source of liquid and the tip guard cavity, wherein when a breach occurs in the wall of the tip guard liquid will flow out of the breach.

Further, although the drawing illustrates the spray tip 36 as being press fit into the tip guard 20, other means for placing these two components in sealing engagement are contemplated and are well known. Further, the components could be integral.

In addition, the tip guard of the present invention is useful for all types of airless spray apparatus and is not limited to the manual spray gun 10 shown in FIG. 1. For example, a tip guard according to the present invention could be used with an automatic airless spray gun which is pneumatically remotely energized and does not include a trigger in the nature of trigger 16 shown in FIG. 1. Also, clearly, a tip guard according to the present invention could be used with a wide variety of manual spray guns and is not limited to the spray gun 10 shown in FIG. 1. Finally, although paint spraying applications are mentioned throughout the description set forth above, the present invention is clearly applicable to high pressure cleaners and water knives, for example.

While only a limited number of embodiments have been illustrated and described, many other variations may be made in a particular design and configuration without departing from the scope of the invention as set forth in the appended claims.

We claim:

1. A spray gun apparatus for airlessly spraying a liquid, comprising:

(a) a spray gun housing defining a fluid supply cavity having inlet and outlet ports;

(b) a spray tip connected to said housing at said outlet port suitable for providing a spray of high-pressure fluid passing therethrough, said spray tip defining an orifice extending along an axis and having upstream and downstream ends; sand upstream end being connected in fluid communication with said supply cavity;

(c) means operatively connected with said cavity inlet port for supplying a liquid under pressure to said supply cavity from a pressurized source of such liquid; and (d) a safety tip guard operatively connected to said housing and disposed adjacent said downstream end of said spray tip orifice and having a portion thereof extending in the direction of said orifice axis, said extending portion having a wall defining a tip guard cavity connected in fluid communication with said supply cavity said tip guard cavity extending to a position downstream of the orifice; wherein a breach in said wall will cause a portion of liquid within said tip guard cavity to escape through the breach, thereby decreasing pressure within said supply cavity at said upstream end of said spray tip orifice.

2. The airless spraying apparatus according to claim 1, wherein said supply cavity comprises a spray tip cavity adjacent the upstream end of said spray tip orifice.

3. The airless spraying apparatus according to claim 2, wherein when a portion of the liquid escapes through the breach the pressure of the liquid contained within said spray tip cavity decreases to diminish the pressure of the liquid that passes through said spray tip orifice to a safe level for preventing penetration of human skin.

4. The airless spraying apparatus according to claim 1, wherein said tip guard cavity extends in said axial direction within said extending portion to at least that axial distance from said downstream orifice end at which the pressure of said fluid passing through said orifice under normal operative conditions has reduced to a level that will not penetrate human skin.

5. The airless spraying apparatus according to claim 1, wherein said safety tip guard comprises a duck bill tip guard, wherein said axially extending portion comprises a pair of axially extending tines, and said tip guard wall comprises inner walls and outer walls of said tines.

6. The airless spraying apparatus according to claim 5, wherein said tip guard cavity comprises a pair of axially extending cavities formed by said inner and outer walls of said tines.

7. The airless spraying apparatus according to claim 6, wherein each of said axially extending tip guard cavities extends axially within its associated tine to a safe distance from said spray tip orifice.

8. The airless spraying apparatus according to claim 7, wherein said airless spraying apparatus is a spray gun.

9. The airless spraying apparatus according to claim 3, wherein said safety tip guard comprises a duck bill tip guard, wherein said axially extending portion comprises a pair of axially extending tines, and said tip guard wall comprises inner walls and outer walls of said tines.

10. The airless spraying apparatus according to claim 9, wherein said tip guard cavity comprises a pair of axially extending cavities formed by said inner and outer walls of said tines.

11. The airless spraying apparatus according to claim 10, wherein each of said axially extending cavities extends axially within its associated tine to a safe distance from said spray tip orifice.

12. A safety tip guard suitable for use with a spray tip of an apparatus for airlessly spraying a liquid, wherein the spray tip forms a spray tip orifice having an axis, an upstream end and a downstream end; wherein said apparatus comprises means for carrying the liquid from a pressurized source of the liquid to the upstream end of the spray tip orifice and defines a supply cavity in fluid communication with the liquid carrying means; said safety tip guard being suitable for operative connection relative to said spray tip, and comprising an axially extending portion suitable for positioning proximate the downstream end of the spray tip orifice, said axially extending portion comprising a tip guard wall forming a tip guard cavity suitable for being connected in fluid communication with the supply cavity said tip guard cavity extending to a position downstream of the orifice; whereby when said safety tip guard is operatively disposed relative to the spray tip such that said tip guard cavity is in fluid communication with said supply cavity containing the pressurized liquid, a breach in said tip guard wall will allow a portion of the liquid to escape through the breach.

13. The safety tip guard according to claim 12, wherein the supply cavity comprises a spray tip cavity adjacent the upstream end of the spray tip orifice.

14. The safety tip guard according to claim 13, wherein when a portion of the liquid escapes through the breach the pressure of the liquid contained within the spray tip cavity decreases to diminish the pressure of liquid flowing through the spray tip orifice to a safe level.

15. The safety tip guard according to claim 12, wherein said tip guard cavity extends axially within said axially extending portion to a safe distance from the spray tip orifice.

16. The safety tip guard according to claim 12, wherein said safety tip guard comprises a duck bill tip guard, wherein said axially extending portion comprises a pair of axially extending tines, and said tip guard wall comprises inner walls and outer walls of said tines.

17. The safety tip guard according to claim 16, wherein said tip guard cavity comprises a pair of axially extending cavities formed by said inner and outer walls of said tines.

18. The safety tip guard according to claim 17, wherein each of said axially extending cavities extends axially within said associated tine to a safe distance from said spray tip orifice.

19. The safety tip guard according to claim 12, wherein the apparatus for airless spraying is a spray gun.

20. A method for guarding a spray tip orifice of a spray tip of a spraying apparatus of the type suitable for airlessly spraying a liquid, said spray tip orifice having an axis, an upstream end and a downstream end; wherein the spraying apparatus is further characterized by means for carrying the liquid from a pressurized source of the liquid to the upstream end of the spray tip orifice, and defines a supply cavity in fluid communication with the liquid carrying means; said method comprising:

(a) selecting a safety tip guard comprising an extending portion comprising a tip guard wall forming a tip guard cavity;

(b) operatively disposing the tip guard relative to the liquid carrying means;

(c) operatively disposing the tip guard relative to the spray tip such that said extending portion projects beyond the downstream end of said spray tip orifice in the axial direction; and (d) connecting the tip guard cavity in fluid communication with the supply cavity; whereby when the supply cavity contains the liquid, a breach in the tip guard wall will allow a portion of the liquid to escape through the breach.

21. The method according to claim 20, wherein said supply cavity comprises a spray tip cavity adjacent the upstream end of the spray tip orifice.

22. The method according to claim 21, wherein when a portion of the liquid escapes throgh the breach the pressure of the liquid contained within the spray tip cavity decreases to reduce the pressure of liquid ejected through the spray tip orifice to a safe level.

23. The method according to claim 20, wherein said tip guard cavity extends axially within said axially extending portion to a safe distance from the spray tip orifice.

24. The method according to claim 20, wherein said safety tip guard comprises a duck bill shaped tip guard, wherein said axially extending portion comprises a pair of axially extending tines, and said tip guard wall comprises inner walls and outer walls of said tines.

25. The method according to claim 24, wherein said tip guard cavity comprises a pair of axially extending cavities formed by said inner and outer walls of said tines.

26. The method according to claim 25, wherein each of said axially extending cavities extends axially within said associated tine to a safe distance from the spray tip orifice.

27. The method according to claim 26, wherein the airless spraying apparatus is a spray gun.

* * * * *